United States Patent [19]

Kosak

[11] Patent Number: 4,584,645

[45] Date of Patent: Apr. 22, 1986

[54] EMERGENCY OPERATION DEVICE FOR MICROCOMPUTER-CONTROLLED SYSTEMS

[75] Inventor: Wolfgang Kosak, Möglingen, Fed. Rep. of Germany

[73] Assignee: Robert Bosch GmbH, Stuttgart, Fed. Rep. of Germany

[21] Appl. No.: 515,238

[22] Filed: Jul. 19, 1983

[30] Foreign Application Priority Data

Jul. 23, 1982 [DE] Fed. Rep. of Germany ..... 3227546
Jun. 20, 1983 [DE] Fed. Rep. of Germany ..... 3322074

[51] Int. Cl.[4] ..... F02D 31/00

[52] U.S. Cl. ..... 364/431.11; 371/14; 123/417; 123/479

[58] Field of Search ..... 364/186, 184, 187, 431.04, 364/431.11; 371/14; 123/417, 479

[56] References Cited

U.S. PATENT DOCUMENTS 4,242,728 12/1980 Hartford ..... 371/14 X
4,245,315 1/1981 Barman et al. ..... 364/431.11
4,255,789 3/1981 Hartford et al. ..... 364/723
4,310,889 1/1982 Imai et al. ..... 364/431.04
4,328,547 5/1982 Barman et al. ..... 364/431.11
4,370,962 2/1983 Hosaka ..... 123/416
4,386,427 5/1983 Hosaka ..... 371/11
4,414,949 11/1983 Honig et al. ..... 123/406 X
4,485,784 12/1984 Fujii et al. ..... 123/417
4,491,112 1/1985 Kanegae et al. ..... 123/399

FOREIGN PATENT DOCUMENTS 3046073 9/1981 Fed. Rep. of Germany .
2458106 12/1980 France .
2104247 3/1983 United Kingdom .

*Primary Examiner*—Jerry Smith
*Assistant Examiner*—Allen MacDonald
*Attorney, Agent, or Firm*—Edwin E. Greigg

[57] ABSTRACT

An emergency operation device for a microcomputer-control system, in particular an idling charge regulating means in a motor vehicle, has a microcomputer which has both a signal output for emitting control signals generated by the microcomputer and a further output for emitting regular failsafe pulses. A failsafe circuit monitors the regular occurrence of the failsafe pulses. Upon the occurrence of a failsafe signal from the failsafe circuit, a reset input of the microcomputer is actuated, and at the same time the system is supplied via a logic block with an emergency operation signal from an emergency operation function generator.

19 Claims, 10 Drawing Figures

FAILSAFE CIRCUIT
FUNCTION GENERATOR

FAILSAFE CIRCUIT
FUNCTION GENERATOR a)
b)
c)
d)
e)

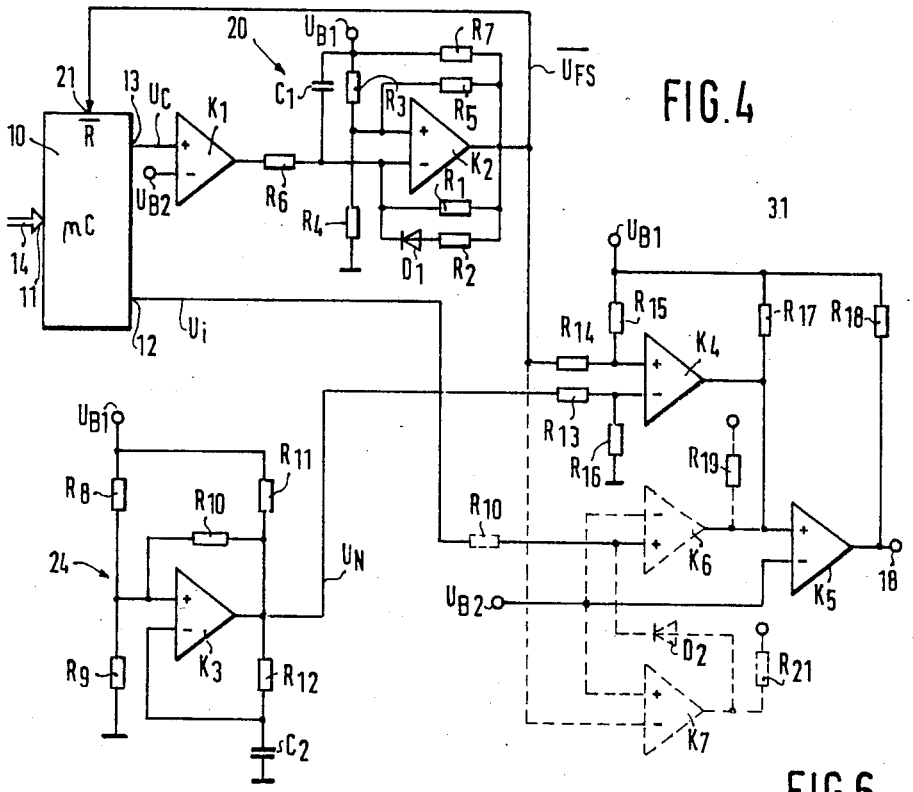
FIG. 4
FIG. 5
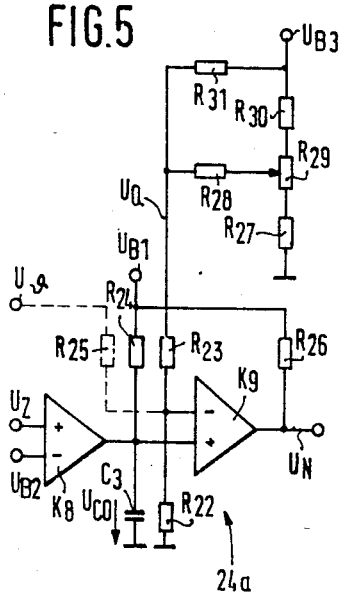
FIG. 6
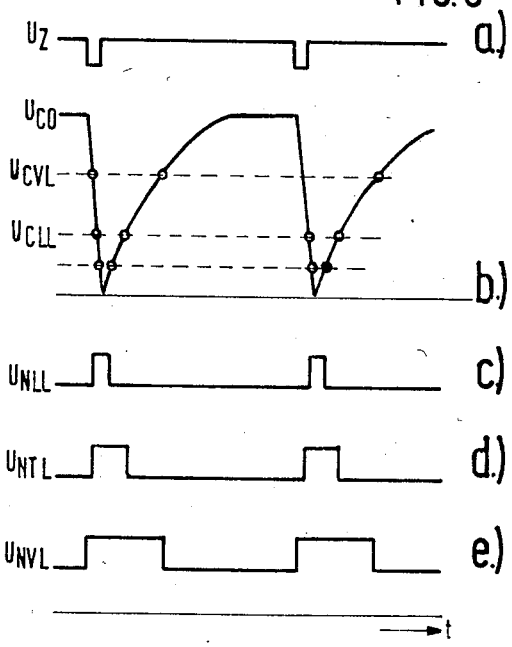

EMERGENCY OPERATION DEVICE FOR MICROCOMPUTER-CONTROLLED SYSTEMS

BACKGROUND OF THE INVENTION

The invention is based on an emergency operation device as generally defined hereinafter.

For controlling system functions, it is known to use microcomputers which derive control signals for the actuation of final control elements from one or more operating parameters of the system. In motor vehicles, such devices are used for instance in operating injection systems, ignition systems, transmission control means or the regulation of the idling charge.

A microcomputer-controlled means of internal combustion engine regulation is described in SAE Technical Paper No. 810157. The microcomputer used there generates regular control pulses, which are examined in a memory circuit as to whether they appear at regular intervals. A monostable multivibrator is also provided, the output signal of which can be supplied to the injection system and the ignition device. Below a predetermined engine speed, the regular control pulses are suppressed, in particular when the engine is started. The memory circuit then serves to assure that the injection system or the ignition device will not be supplied with the control values provided by the usual regulation means but will instead receive a pulse train from the monstable multivibrator.

In the known device, however, no emergency operation system is provided, because the monitoring of the regular pulses is essentially performed only below an engine speed which is lower than idling rpm. Yet with this device, should there be some malfunction while driving, the engine speed would first have to drop below this low rpm, and then the switchover to the monostable multivibrator would have to be overridden by starting the engine once again.

OBJECT AND SUMMARY OF THE INVENTION

The emergency operation device according to the invention has the advantage over the prior art in that a continuous monitoring of the microcomputer control is performed, and once a malfunction disappears there is a transition back to normal regulation no matter what the operating state of the engine.

The device according to the invention generates not only a control signal for normal operation, but also both an emergency operation signal for emergency operation and a failsafe signal for the purpose of recognizing an emergency. By variously linking these signals using logic elements, various advantages can be attained in different applications.

In a first form of embodiment of a logical linkage system, the control signal and the emergency operation signal are passed on simultaneously during normal operation, so that at least one of the signals can be used for operating the system should the other signal be absent and in case too the failsafe circuit is not functioning properly.

In a second variant of a logical linkage according to the invention, by contrast, the emergency operation signal is alternatively passed on only if the failsafe circuit recognizes an emergency. The result is greater reliability in other operational instances, and it is substantially simpler to make the emergency operation signal in turn dependent on operating parameters, in contrast to the first variant described above, where the emergency operation signal must always be smaller than the control signal for normal operation, for safety reasons.

Finally, a third variant of a logical linkage according to the invention is also provided, in which the entire logical linkage is realized by only a single diode, so that a particularly simple structure can be attained.

If the control signal and the emergency operation signal are each embodied as a regular pulse train, then it is no longer critical if both signals become effective simultaneously, so long as the duty cycle of the emergency operation signal is substantially smaller than that of the control signal; thus when the signals appear simultaneously, the control signal will always have priority.

If the control signal and the emergency operation signal are combined by means of a logical OR linkage, then a malfunction may occur if the output of the microcomputer furnishing the control signal is short-circuited to ground because of a malfunction. This eventuality can be alleviated of by providing that a further comparator which compensates for the ground connection be incorporated in the supply line of the control.

Especially in the case where there is an alternative forwarding of either the control signal or the emergency operation signal—as in the second variant of a logical linkage according to the invention—it is advantageous to make the emergency signal for its part dependent on operating parameters of the system, such as the air quantity, the temperature or the rpm of an internal combustion engine. Then the advantageous characteristics of regulation will be retained even in the event of emergency operation.

It is particularly simple and advantageous to provide that the emergency operation signal be generated using an emergency operation function generator, which is embodied as a monostable multivibrator controlled by a reference signal of the system, for instance an ignition signal of the engine of a motor vehicle. It is particularly simple then to make the timing duration controlled by the monostable multivibrator dependent on operating parameters of the motor vehicle.

If the failsafe circuit is triggered via a capacitor, the oscillator function or even the automatic reset function of the failsafe circuit will be retained even if, as a result of a further malfunction, the supply line of the failsafe circuit is short-circuited to ground or is connected to a reference potential.

Finally, particularly good functioning is attained provided that upon the occurrence of an emergency the failsafe signal switches the output of the microcomputer which furnishes the control pulses to a reference potential, such as ground.

If the input of the failsafe circuit is decoupled using a diode, the internal resistance of the associated output of the microcomputer will not affect the switching time of the input stage of the failsafe circuit, which conventionally comprises an RC member with a transistor connected to its output. As a result, a sufficiently long safety interval can be provided between the courses of regulation on the part of the transistor occurring during normal operation and the attainment of the switching thresholds in the event that the control pulses are absent, while at the same time the reaction time for the switchover in case of an emergency is short.

The invention will be better understood and further objects and advantages thereof will become more apparent from the ensuing detailed description of preferred embodiments taken in conjunction with the drawings.

BRIEF DESCRIPTION OF THE DRAWINGS

FIG. 4 is a more detailed circuit diagram for the second form of embodiment shown in FIG. 2;

FIG. 5 is a variation of an emergency operation function generator influenced by operating parameters;

FIG. 6 provides signal courses over time to explain the disposition shown in FIG. 5;

DESCRIPTION OF THE PREFERRED EMBODIMENTS

Figure 1:
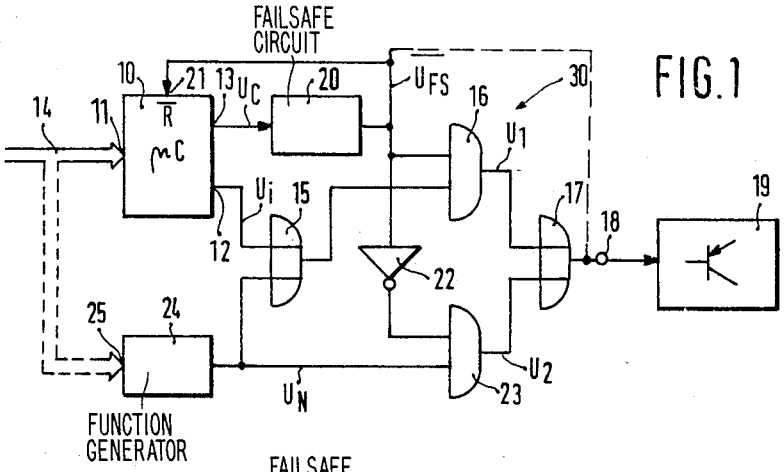
FIG. 1 is a block circuit diagram of a first form of embodiment of an emergency operation device according to the invention.

FIG. 1 shows a microcomputer 10, which serves to control a system, such as an idling charge regulation system in a motor vehicle. The microcomputer 10 has an input 11 and two outputs 12 and 13. At the input 11, the microcomputer 10 is supplied via a data line 14 with signals which are dependent on operating parameters. In the application mentioned here by way of example of an idling charge regulation system of a motor vehicle, these operating parameters may be, for example, the air quantity Q, the rpm n or the temperature $\theta$.

At the signal output 12, the microcomputer 10 generates control signals $U_i$, which serve to trigger final control elements of the system. At the other output 13, on the other hand, failsafe pulses $U_c$ are generated, the appearance of which at regular intervals is a criterion for the proper functioning of the microcomputer 10.

The control signals $U_i$ are directed via an OR gate 15 and an AND gate 16 as well as a further OR gate 17 to a terminal 18, which is connected to an end stage 19, which is intended to symbolize the final control elements.

The failsafe pulses $U_c$ reach a failsafe circuit 20, which generates a failsafe signal $U_{FS}$ whenever the failsafe pulses $U_c$ do not occur regularly. The failsafe pulses $U_c$ are emitted only when the microcomputer 10 is operated entirely according to its program. To this end, monitoring interrogations are built into various important points in the program, and all must be responded to positively. In this manner, a self-testing operation is performed, and the absence of the failsafe pulses $U_c$ means that the program of the microcomputer 10 is no longer operating properly or that the microcomputer 10 may itself have failed. As the symbol $U_{FS}$ already indicates, the occurrence of a malfunction is indicated in the exemplary embodiments described herein by a logical L signal. This signal travels to a reset input 21 of the microcomputer 10, whose logic is selected to be such that the microcomputer 10 is reset if an L signal is applied.

An emergency operation function generator 24 generates an emergency operation signal $U_N$ in the form of a pulse train, and this signal $U_N$ is supplied both to the other input of the OR gate 15 and to one input of and AND gate 23, the output of which is connected with the other input of the OR gate 17. Finally, the failsafe signal $U_{FS}$ is supplied both to the other input of the AND gate 16 and, via an inverter 22, to the other input of the AND gate 23. The output signals of the AND gates 16, 23 are designated by the symbols $U_1$ and $U_2$, respectively.

The circuit layout in FIG. 1 which is defined by the logic elements 15, 16, 17, 22 and 23 is identified generally as logic block 30.

Figure 2:
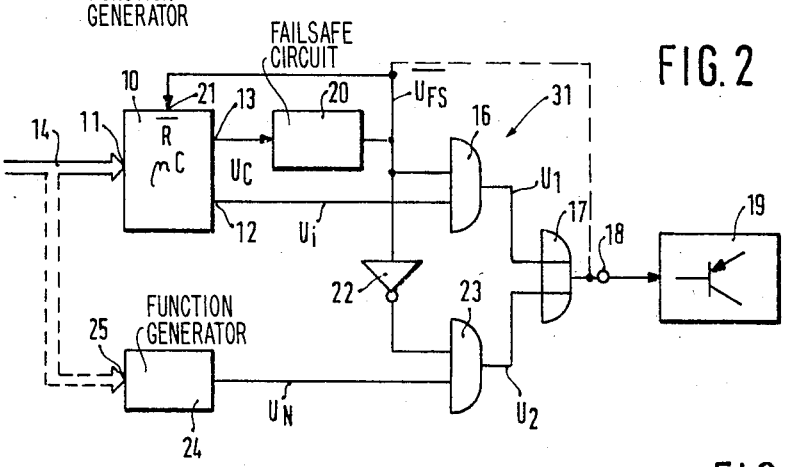
FIG. 2 is a block circuit diagram of a second form of embodiment of an emergency operation device according to the invention.

Deviating from the exemplary embodiment of FIG. 1, the exemplary embodiment shown in FIG. 2 has a logic block 31, which differs in that the OR connection provided by the OR element 15 is absent here. The control signal $U_i$ is instead supplied directly to the AND gate 16.

The logic block 30 in FIG. 1 assures that either the AND gate 16 (malfunction-free operation) or the AND gate 23 (emergency operation) is driven. In the first case, the control signal $U_i$ and the emergency operation signal $U_N$ becomes effective simultaneously via the OR gate 15, while in the second case only the emergency operation signal $U_N$ is effective. The linking of the control signal $U_i$ and the emergency operation signal $U_N$ via the OR gate 15 has the advantage, however, that in a conceivable instance of malfunction in which the failsafe pulses $U_c$ continue to occur, so that no failsafe signal $U_{FS}$ is generated yet no control signal $U_i$ is generated, the emergency operation signal $U_N$ will continue to travel via the driven AND gate 16 to the output. However, this advantage must be contrasted with the disadvantage that this possible malfunction can also occur systematically during overrunning [ie engine braking] in vehicles having an overrunning cutoff, because in that case the microcomputer 10 will be functioning properly and emitting failsafe pulses $U_c$. On the other hand, however, when the overrunning cutoff is in effect the control pulses $U_i$ are suppressed. Further circuitry provisions are therefore needed in the variant shown in FIG. 1 for suppressing the emergency operation signal $U_N$ in the case of overrunning cutoff, so that the desirable overrunning cutoff is not overridden by switching through the emergency operation signal via the AND gate 16. In a genuine instance of malfunction, however, it is also possible that these emergency operation pulses may be suppressed improperly, making emergency operation impossible.

This possible disadvantage is precluded in the variant embodiment shown in FIG. 2, because the emergency operation signal $U_N$ is not supplied to any other element but the AND gate 23, to which it is supplied directly, and the AND gate 23 is driven only in case of emergency via the inverter 22.

Figure 3:
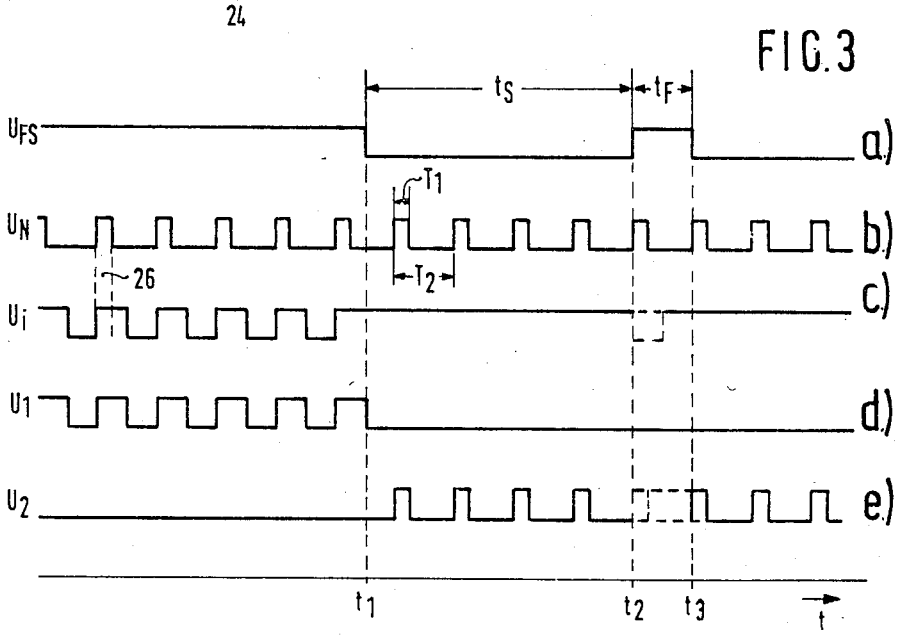
FIG. 3 provides pulse diagrams to explain the forms of embodiment shown in FIGS. 1 and 2.

The variant embodiment of FIG. 2 additionally has the advantage that the emergency operation signal $U_N$ can be influenced more easily in accordance with operating parameters than is the case with the variant embodiment of FIG. 1. As may be seen from FIGS. 1 and 2, the data line 14, in an alternative embodiment, is carried to an input 25 of the emergency operation function generator 24, so that even during emergency operation genuine regulation of the system can still be performed. In the variant embodiment of FIG. 1, however, such regulation can lead to problems because of the OR linkage in gate 15, for the reasons given below in connection with FIG. 3. As compared with the variant embodiment of FIG. 1, the variant of FIG. 2 has a much broader range of possible variation, so that the emergency operation signal $U_N$ too can be influenced over a wide range by operating parameters.

The failsafe signal $U_{FS}$ is shown in FIG. 3*a*. As is known from the prior art, the occurrence of a malfunction at time $t_1$ first brings about a blocking phase having the duration $t_s$. After this period has elapsed, a shorter unblocking phase having the duration $t_f$ follows at time $t_2$, lasting until time $t_3$.

FIG. 3*b* shows the emergency operation signal $U_N$, which is generated as a pulse train having a duty cycle ratio of $T_1/T_2$.

FIG. 3*c* shows the control signal $U_i$. As seen at the point marked 26, the pulse width of the control signal $U_i$ is substantially greater than that of the emergency operation signal $U_N$. This is particularly necessary in the variant embodiment of FIG. 1, since the two signals are linked with one another in the OR gate 15, and when it appears the control signal $U_i$ is supposed to have priority. Yet if the pulse width of the emergency operation signal $U_N$ is always substantially smaller, then this signal $U_N$ will not make itself felt during normal operation. Problems could arise, on the other hand, if in the variant embodiment of FIG. 1 the emergency operation signal were also to be varied in accordance with operating parameters, because under some circumstances it could then happen that the pulse width of the emergency operation signal $U_N$ could exceed that of the control signal $U_i$, making incorrect functioning possible during normal operation. This is the reason why in the variant embodiment of FIG. 2 there is a much wider range of opportunity for making the emergency operation signal $U_N$ dependent on operating parameters.

If the malfunction occurs at time $t_1$, the failsafe signal $U_{FS}$ switches from logical H to logical L. The AND gate 16 is then blocked, and the AND gate 23 is driven. The voltage $U_1$ at the output of the AND gate 16 correspondingly goes to logical L, while the voltage $U_2$ at the output of the AND gate 23 now results in the emergency operation signal $U_N$. During the unblocking phase between times $t_2$ and $t_3$, an indefinite state is thus brought about, because the control signal $U_i$ may be either logical H or logical L.

In view of the duty cycle ratio $\tau_N = T_1/T_2$ of the emergency operation signal and the duty cycle ratio $t_f/(t_s+t_f)$ of the failsafe signal $U_{FS}$, the result of the brief indefinite state in the unblocking phase is an error of the duty cycle ratio during a longterm computer malfunction of $$\tau_{NOT} = \frac{\tau_N \cdot t_s \pm t_f}{t_s + t_f}$$

In a practical application instance, the duty cycle ratio of the emergency operation signal may for example be 0.35, while $t_f$ amounts to 10 ms and $t_s$ amounts to 140 ms. The result is an effective duty cycle ratio NOT of the resultant emergency operation of 0.35±0.04. This deviation is small, however, and may be considered negligible in an emergency.

The formula given above is only an approximation. If the actual computer signal $U_i$ established in the case of a malfunction is taken into consideration (see FIG. 3*c*), then the result is $$\tau_{NOT} = \frac{T_1(t_s + t_f) \pm t_x}{T_2(t_s + t_f)}$$

where $t_x = (T_2 - T_1) \cdot t_f$, $U_i$=high, or $t_x = -T_y \cdot t_f$, $U_i$=low.

FIG. 4 provides a more detailed overview of a form of embodiment of an emergency operation device according to the invention corresponding approximately to the block circuit diagram of the variant embodiment shown in FIG. 2. Identical components are therefore identified by the same reference numerals. Thus one can readily locate the failsafe circuit 20 in the upper part, the emergency operation function generator 24 in the lower left part and the logic block 31 in the right-hand part of FIG. 4.

The failsafe output 13 of the microcomputer 10 is provided with an "active low" signal; that is, the pulse train changes from logical H to logical L upon the appearance of a signal. In the case of malfunction, the failsafe output 13 is at logical H. The failsafe pulses $U_c$ travel to the non-inverting input of a comparator $K_1$, the inverting input of which is connected with a reference voltage $U_{B2}$, for instance 1.5 V. The output of the comparator $K_1$ leads to the failsafe circuit 20. This output is connected via a resistor $R_6$ with the inverting input of a further comparator $K_2$. The output of this further comparator $K_2$ is connected via a resistor $R_7$ with a reference voltage $U_{B1}$, for instance 5 V. From the reference voltage $U_{B1}$ a capacitor $C_1$ leads to the inverting input and a resistor $R_3$ leads to the non-inverting input of the comparator $K_2$, which is furthermore coupled via a resistor $R_5$ with the output. The output of the comparator $K_2$ is furthermore fed back via a resistor $R_1$, and parallel to it the series circuit comprising a resistor $R_2$ and a diode $D_1$, to the inverting input. Finally, the non-inverting input is also conected to ground via a resistor $R_4$.

The failsafe circuit 20 accordingly comprises a threshold switch having a hysteresis property, which switches through whenever the failsafe pulses $U_c$ either charge or no longer charge the capacitor $C_1$. The duty cycle ratio $t_f/(t_f+t_s)$ is generated by the different charging or discharging branches, since for charging the capacitor $C_1$ in one direction it is the parallel circuit of the resistors $R_1$, $R_2$ which is effective, while in the other direction, because of the diode $D_1$, only the resistor $R_1$ is effective. The voltage divider $R_3/R_5//R_4$ provides the static lower switching threshold, for instance 1 V, and the voltage divider $R_3/R_5/R_7/R_4$ determines the static upper switching threshold, for instance 2 V. Thus a wide safety interval is attained between malfunction voltages and peaks, which is particularly important when the invention is used in motor vehicles.

The overall result at the output of the comparator K2 is a failsafe signal $U_{FS}$, which during malfunction-free operation with a charged capacitor $C_1$ is logical H, while during a malfunction when the capacitor $C_1$ is no longer charged, it changes to logical L.

With a persistent malfunction (that is, the failsafe pulses $U_c$ are absent for a long period), the failsafe circuit 20 functions as an oscillator having the duty cycle $\tau_{FS}=t_f/(t_f+t_s)$ Since the microcomputer in the reset state changes to logical H and comparator K2, as an OPEN collector output, does not influence the failsafe circuit.

The failsafe signal $U_{FS}$ is supplied both to the reset input 21 of the microcomputer 10 and to the logic block 31. As indicated by the symbol $\overline{R}$ in the microcomputer, the reset input 21 reacts to signals having logical L, so that in the case of a malfunction, when $U_{FS}$ is logical L, the microcomputer 10 is set back. The failsafe output 13 changes to logical H.

The emergency operation function generator 24 is embodied as a freely oscillating oscillator in the exemplary embodiment of FIG. 4. To this end, a comparator $K_3$ is provided, which is positively coupled with a resistor $R_{10}$ and negatively coupled with a resistor $R_{12}$, with a further capacitor $C_2$ also connected from the resistor $R_{12}$ to ground. The output of the comparator $K_3$ is connected via a resistor $R_{11}$, and its non-inverting input is connected via a resistor $R_8$, to the reference potential $U_{B1}$. The non-inverting input is also connected to ground via a resistor $R_9$. The result, with suitable dimensioning of the components, is an emergency operation signal $U_N$, which represents a pulse train switching back and forth between voltages of 0.4 V and 4.2 V.

The energency operation signal $U_N$, like the failsafe signal $U_{FS}$, is supplied to the logic block 31.

The logic block 31 substantially comprises two comparators $K_4$, $K_5$, the output of the comparator $K_4$ being connected to the non-inverting input of the comparator $K_5$. The comparator $K_4$ is supplied at its non-inverting input with the failsafe signal $U_{FS}$ via a resistor $R_{14}$, and at its inverting input with the emergency operation signal $U_N$ via a resistor $R_{13}$. The non-inverting input is connected via a resistor $R_{15}$ to the reference potential $U_{B1}$ and the inverting input is connected via a resistor $R_{16}$ to ground. The outputs of the comparators $K_4$, $K_5$ are likewise connected via respective resistors $R_{17}$ and $R_{18}$ to the reference potential $U_{B1}$. While in a first variant the control signal $U_i$ is supplied from the signal output 12 of the microcomputer 10 directly to the non-inverting input of the comparator $K_5$, the inverting input of this comparator being connected to the reference potential $U_{B2}$, in a further variant two further comparators $K_{6,7}$ are provided in the supply line of the control signal $U_i$. A resistor $R_{20}$ is connected between the signal output 12 and the non-inverting input fo the comparator $K_6$, the output of which is connected with the non-inverting input of the comparator $K_5$ and via a resistor $R_{19}$ with a reference potential. The further comparator $K_7$ is connected at its non-inverting input with the reference potential $U_{B2}$ and at its inverting input with the failsafe signal $U_{FS}$. The output of the comparator $K_7$ leads via a diode $D_2$ to the non-inverting input of the comparator $K_6$ as well as via a resistor $R_{21}$ to a reference potential.

The emergency operation signal $U_N$ is reduced via the resistors $R_{13}$, $R_{16}$ to a value of 0.2 V and 3 V, respectively. In contrast, the failsafe signal $U_{FS}$ is elevated via the voltage divider $R_{14}$, $R_{15}$, which leads to the reference potential $U_{B1}$, in such a manner that in the event of a malfunction a voltage of 1.5 V, for example, results at the non-inverting input of the comparator $K_4$. Then the comparator $K_4$ effects clocking with the frequency of the emergency operation function generator 24, and at the non-inverting input of the comparator $K_5$ a voltage course is established as shown in FIG. 3*e*.

The comparators $K_6$, $K_7$ serve to cover the theoretically conceivable malfunction where the signal output 12 is short-circuited to ground. Since with direct triggering of the comparator $K_5$ the emergency operation signal would also be suppressed in such a case, the comparator $K_7$ is provided in addition, this comparator $K_7$ being actuated by the failsafe signal $U_{FS}$. If the failsafe signal $U_{FS}$ is logical L, then the comparator $K_7$ switches to logical H, since its non-inverting input is connected with the potential $U_{B2}$. Then, however, the comparator $K_6$ is correspondingly switched over to logical H, regardless of whether the signal output 12 of the microcomputer is grounded or not.

FIG. 5 shows a further exemplary embodiment of an emergency operation function generator 24*a*. In this exemplary embodiment, a monostable multivibrator is used, which is triggered in accordance with a system parameter.

In the input of the emergency operation function generator 24*a*, a comparator $K_8$ is disposed, the non-inverting input of which receives a signal $U_Z$, which is derived by way of example from an ignition system of a motor vehicle engine. In contrast to this, the reference potential $U_{B2}$ is applied to the inverting input of the comparator $K_8$. The output of the comparator $K_8$ is connected with the non-inverting imput of a comparator $K_9$. From this non-inverting input, a capacitor $C_3$, at which a voltage $U_{Co}$ drops, leads to ground and a resistor $R_{24}$ leads to the reference potential $U_{B1}$. The output of the comparator $K_9$ is likewise connected to the reference potential $U_{B1}$ via a resistor $R_{26}$. From the inverting input of the comparator $K_9$, one resistor $R_{22}$ leads to ground and one resistor $R_{23}$ leads first via a resistor $R_{31}$ to a reference potential $U_{B3}$ of 8 V, for instance, and second via a resistor $R_{28}$ to the tap of a potentiometer $R_{29}$, which is disposed in series with the resistors $R_{30}$, $R_{27}$ between the reference potential $U_{B3}$ and ground.

In a further embodiment of the disposition according to FIG. 5, the inverting input of the comparator $K_9$ can also be supplied via a resistor $R_{25}$ with a signal $U\theta$.

The signal $U_Z$ represents the top dead center position OT of a piston of an internal combustion engine, by way of example. The signal $U_Z$, as is apparent from FIG. 6*a*, is "active low" and has a timing duration by way of example of 150±20 μs. Thus this signal is particularly suitable as an interrupt signal for conventional microprocessors available commercially.

The potentiometer $R_{29}$ in FIG. 5 represents the potentiometer loop of an air flow rate meter, by way of example. Thus a signal $U_Q$ *is present at the junction of resistors* $R_{28}$, $R_{31}$ with the resistor $R_{23}$. The resistors $R_{28}$, $R_{31}$ serve to elevate the signal $U_Q$ in the idling and partial-load ranges. The precondition for this is that the resistors $R_{28}$ and $R_{31}$ be very much larger than the resistor $R_{29}$. In this manner, the timing duration of the monostable multivibrator is adjusted in accordance with the air quality, and in the alternative form of embodiment having the temperature signal $U\theta$ it is additionally adjusted in accordance with the temperature. The temperature-dependent adjustment produces particularly favorable warm-up characteristics.

As soon as the signal $U_Z$ shown in FIG. 6*a* changes to logical H, the capacitor $C_3$ charges, as may be seen from FIG. 6*b*. The time constant is $R_{24}$ $C_3$. The capacitor $C_3$ charages until it attains the reference potential $U_{B1}$, for instance 5 V. The switching threshold of the comparator $K_9$ is fixed by the potential which is effective at its inverting input. This potential depends, however, on the position of the air flow rate meter, or in other words on the position of the potentiometer $R_{29}$. In the various operating stages of full load (VL), partial load (TL) and idling (LL), the switching thresholds plotted in FIG. 6*b* result, so that the drive range of the comparator $K_9$ produces an emergency operation signal of $U_{NLL}$, $U_{NTL}$, and $U_{NVL}$, respectively, as is shown in FIGS. 6*c*14 6*e*. It is clear from the diagram that the pulse width increases from idling to full load, at a constant frequency. The pulse width is dimensioned such that with injection pulses for internal combustion engines, for example, a 4-cylinder engine, half the quantity is injected upon each effective ignition pulse.

The overall result is thus a timing duration of the monostable multivibrator which is varied in accordance with the air quantity and, if needed, the temperature as well, as perhaps still further operating parameters, thus producing a system performance regulated in an operationally specific manner even during emergency operation.

Figure 7:
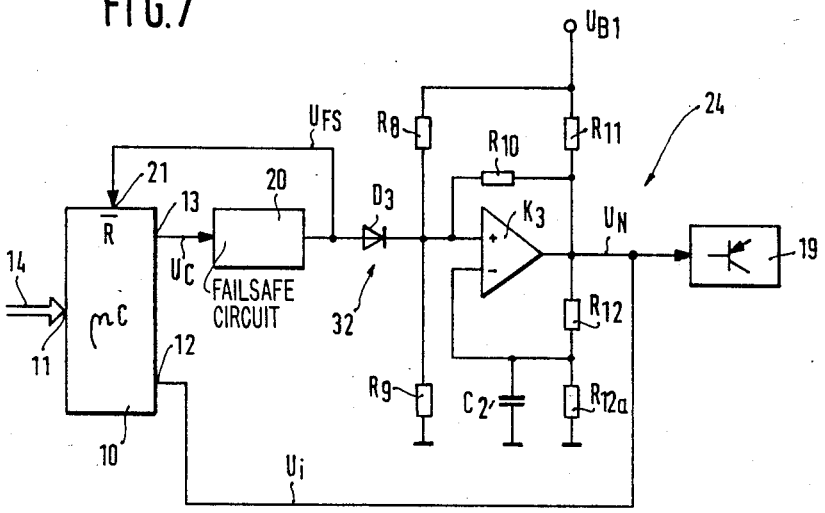
FIG. 7 is a circuit diagram of a third form of embodiment of an emergency operation device according to the invention.

FIG. 7 shows a further variant of an emergency operation device according to the invention.

The cooperation of the microcomputer 10, the failsafe circuit 20 and the emergency operation function generator 24 here correspond to that in the exemplary embodiments described above, and identical reference numerals are accordingly used.

In contrast to the exemplary embodiments of FIGS. 1, 2, 4 and 5, a highly simplified logic block 32 is used in the exemplary embodiment of FIG. 7. The logic block 32 in fact comprises only a diode $D_3$, which is disposed between the output of the failsafe circuit 20 and the input of the emergency operation function generator 24. The end stage 19, which stands for the final control elments of the system, is triggered simultaneously by the emergency operation signal $U_N$ and the control signal $U_i$. During malfunction-free operation, the failsafe signal $U_{FS}$ is at logical H, so that the freely oscillating oscillator acting as the emergency operation function generator 24 is cut off with the comparator $K_3$ via the diode $D_3$. The output of the comparator $K_3$ then assumes a state of logical H, since it is equipped with an open collector in the conventional manner. In order to improve the switching behvavior in this case, a resistor $R_{12a}$ is disposed, in addition to the oscillator circuit used identically in this sense in FIG. 4, parallel to the capacitor $C_2$; at the inverting input of the comparator $K_3$ this resistor $R_{12a}$ generates an unequivocal differential voltage, so that the output will switch cleanly to logical H when the diode $D_3$ is driven.

In the event of malfunctioning, the failsafe signal $U_{FS}$ then assumes the logical L state and the diode $D_3$ blocks, so that the oscillator of the emergency operation function generator 24 can oscillate freely and supply the emergency operation signal $U_N$ to the end stage.

In a preferred embodiment of the invention, the emergency operation signal $U_N$ generated by the emergency operation function generator 24 in this exemplary embodiment according to FIG. 7 is programmed into the microcomputer 10, so that at the transition from a malfunction back to renewed malfunction-free operation, the system at first continues to be regulated with the then-programmed existing emergency operation signal $U_i = U_N$, since in the event of malfunction the registers of the microcomputer will have been erased and thus no rpm information (for instance) will be available. In the case where the invention is applied to the regulation of internal combustion engines, however, the rpm information will again be available two ignition pulses later, so that the microcomputer 10 will be capable of ascertaining the correct rpm and thus making the transition back to performing its own ascertainment of the control signals $U_i$.

A particularly good effect can also be attained by providing that in general the duty cycle ascertained by the microcomputer 10 for the control signal $U_i$ be monitored for plausibility. If this test (self-test) has a negative outcome, then the failsafe circuit 20 is again triggered and the emergency function activated (for instance, in case of a reduction in or absence of the rpm data).

Figure 8:
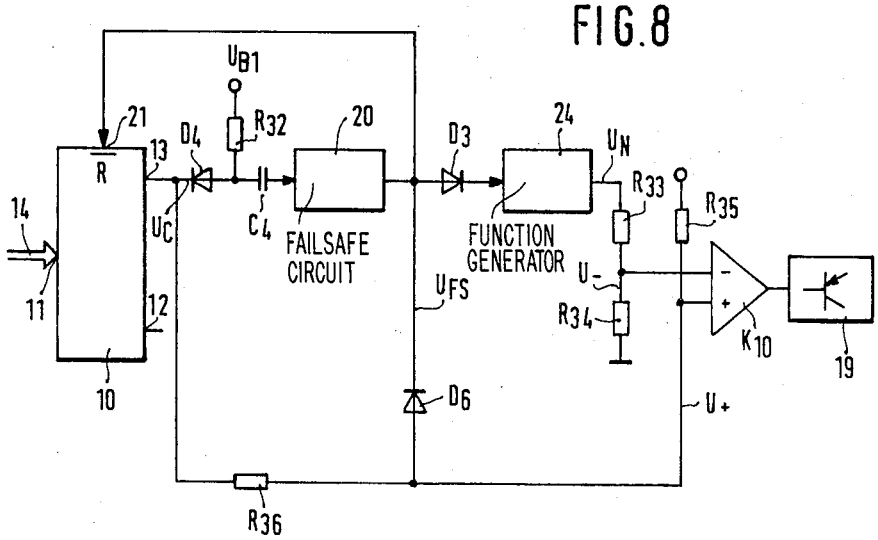
FIG. 8 is a circuit diagram of a fourth form of embodiment of an emergency operation device according to the invention.

In the further exemplary embodiment according to FIG. 8, a particular feature is that the failsafe output 13 of the microcomputer 10 is connected with the input of the failsafe circuit 20 via the series circuit of a diode $D_4$ and a capacitor $C_4$. The junction of elements $D_4$, $C_4$ is connected via a resistor $R_{32}$ to the reference potential $U_{B1}$. The output of the failsafe circuit 20 is also connected to the failsafe output 13 via the series circuit of a diode $D_6$ and a resistor $R_{36}$, and the junction of elements $D_6$ and $R_{36}$ is connected with the non-inverting input of a comparator $K_{10}$, from which a resistor $R_{35}$ leads to reference potential. The inverting input of the comparator $K_{10}$ is connected with the tap of a voltage divider $R_{33}$, $R_{34}$, which is disposed in the output of the emergency operation function generator 24. The output of the comparator $K_{10}$ leads to the end stage 19.

The coupling of the failsafe circuit 20 via the capacitor $C_4$ serves to increase operational reliability. For instance, if a persistent short-circuit to ground or to $U_{B1}$ occurs at the failsafe output 13 as a result of a malfunction, then because of the direct-current decoupling by means of the capacitor $C_4$ this does not cause the cancellation of the reset state, because the failsafe circuit 20 is not influenced thereby. In the event of a malfunction, when the failsafe signal $U_{FS}$ is logical L, the failsafe output 13 is cut off via the diode $D_6$ and the resistor $R_{36}$, in that the voltage $U_+ \approx 1.2$ V prevailing at the junction of elements $D_6$, $R_{36}$ is bracketed. The resistor $R_{35}$ also assures a voltage drop at $D_6$ whenever the failsafe output 13 is persistently short-circuited to ground as mentioned above.

In the event of a malfunction, the emergency operation function generator 24 generates the emergency operation signal $U_N$, which is reduced by division via the voltage divider $R_{33}$, $R_{34}$ to the voltage $U_-$ and switches back and forth between 0.3 V and 3 V, for example.

The functioning of the diode $D_4$ also provided in the input of the failsafe circuit 20 will now be explained, referring to FIGS. 9 and 10.

Figure 9:
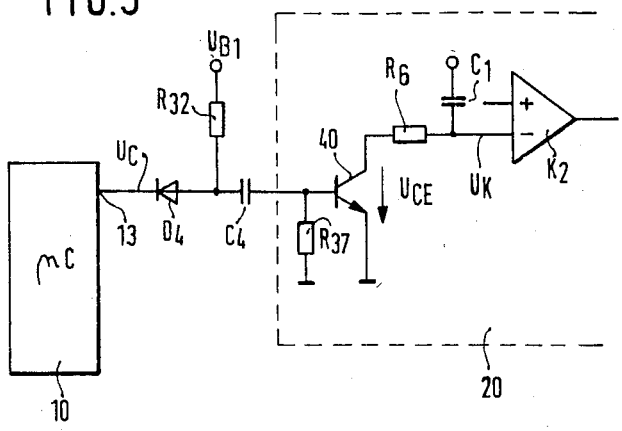
FIG. 9 is a detailed circuit diagram for the input wiring of a failsafe circuit.
Figure 10:
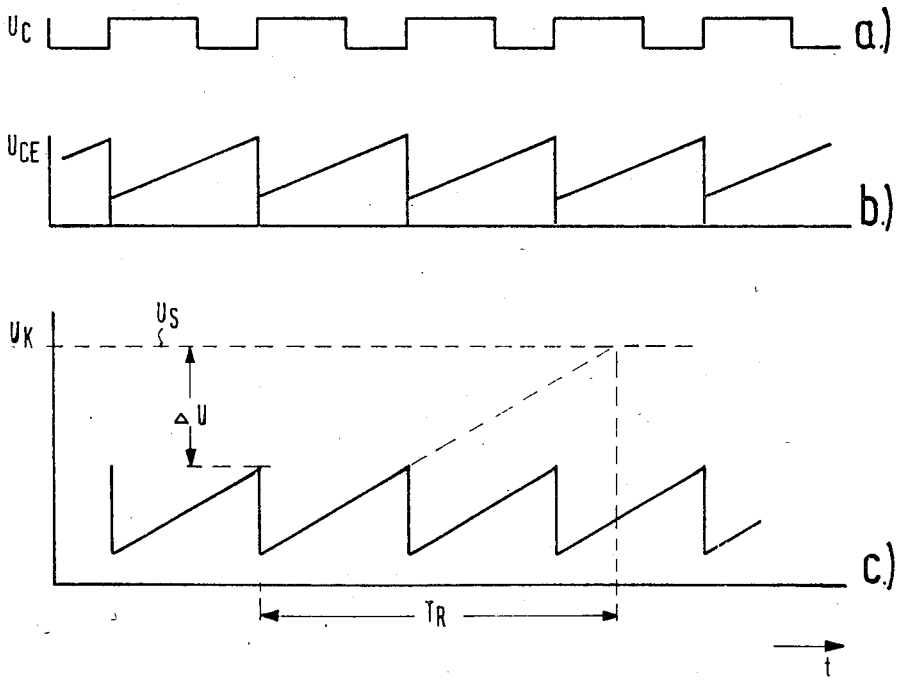
FIG. 10 provides signal courses over time to explain the disposition of FIG. 9.

FIG. 9 shows a detail of the circuit of FIG. 8. The input of the failsafe circuit 20 comprises a transistor 40, the base of which is connected to ground with the shunting resistor $R_{37}$. A voltage $U_{CE}$ drops along the switching path of the transistor 40. A resistor $R_6$ leads from the collector of the transistor 40 to an inverting input of a comparator $K_2$, to which a voltage $U_K$ is applied. The capacitor $C_1$ leads from the inverting input of the comparator $K_2$ to reference potential. The remaining wiring corresponds to what is shown in FIG. 4.

The failsafe pulses $U_c$ and the voltages $U_{CE}$ and $U_K$ of FIG. 9 are shown in terms of their courses over time in FIGS. 10*a*, 10*b* and 10*c*.

The failsafe pulses $U_C$, as shown in FIG. 10*b*, effect a regular charging and an abrupt discharging of the capacitor $C_4$, the time constant of this process being determined by the resistors $R_{32}$, $R_{37}$ as well as by the capacitor $C_4$. In order to prevent an adulteration of this time constant resulting from the internal resistance of the failsafe output $R_{13}$, the diode $D_4$ is provided, which in this sense effects a decoupling. The regular processes of charging and discharging shown in FIG. 10*b* are transferred in the form of the voltage $U_K$ to the inverting input of the comparator $K_2$, as shown in FIG. 10*c*. The interval U between the peak values of the voltage $U_K$, which fluctuates regularly during normal operation, and the switching threshold $U_s$ is characteristic for the reaction time $T_R$ of the system. On the one hand, this interval $\Delta U$ must be kept long, so as to prevent triggering in error; on the other hand, however, a relatively short interval $\Delta U$ is important in order to attain the shortest possible reaction time $T_R$. It is therefore particularly advantageous to uncouple the internal resistance of the failsafe output 13, of 10 . . . 60 kΩ, for example, with the diode $D_4$, so that with components otherwise having close tolerances the shortest possible interval $\Delta U$ and thus a short reaction time $T_R$ can be realized.

In other words, by eliminating these interference effects from consideration, the interval $\Delta U$ can be kept short, without having to fear triggering in error.

Finally, FIGS. 1 and 2 also indicate with dotted lines the possibility of supplying the output signal of the failsafe circuit 20 to the terminal 18 directly as well, which is of significance if it is the failsafe circuit 20 itself which makes a transition to clocked emergency operation in the event of a processor malfunction ascertained by the failsafe circuit 20.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An emergency operation device for a microcomputer-controlled system, in particular for idling charge regulation of an internal combustion engine in motor vehicles, comprising:

a microcomputer having signal inputs corresponding to operating parameters and further having a signal output for emitting first control signals ($U_i$) generated by said microcomputer and a failsafe output ($U_c$) for emitting regular pulses serving as failsafe pulses for continuous monitoring and control of a system output during normal operation of said system, a circuit means for monitoring occurrence of said regular pulses, a function generator for providing second control signals, a logic switching means responsive to said circuit means for supplying an end stage control signal to an end stage of said system, said end stage control signal being selectively chosen from between those of said first control signals and those of said second control signals, said circuit means being operatively arranged for providing a third control signal ($U_{FS}$) comprising a failsafe signal for actuating said logic switching means and further providing a reset signal for said microcomputer in the event of a malfunction, at least one of said first, second and third control signals being selectable to serve as an emergency operation signal ($U_N$) to trigger said end stage, and said emergency operation signal derived from said failsafe signal is free of synchronization with any of said operating parameters of said engine.

2. An emergency operation device as defined by claim 1, wherein said logic switching means links said signals ($U_i$, $U_N$, $U_{FS}$) in accordance with the following relationship:

$$(U_{FS} \wedge (U_i \vee U_N)) \vee (U_N \wedge \overline{U_{FS}})$$

3. An emergency operation device as defined by claim 1, wherein said logic switching means links said signals ($U_i$, $U_N$, $U_{FS}$) in accordance with the following relationship:

$$(U_i \wedge U_{FS}) \vee (U_N \wedge \overline{U_{FS}})$$

4. An emergency operation device as defined by claim 1, wherein said logic switching means links said signals ($U_i$, $U_N$, $U_{FS}$) in accordance with the following relationship:

$$U_i \vee (U_N \wedge \overline{U_{FS}})$$

5. An emergency operation device as defined by claim 4, wherein, said logic switching means includes a diode between said circuit means and said function generator, said signal output of said microcomputer being connected with the output of said function generator.

6. An emergency operation device as defined by claim 1 wherein said emergency operation signal ($U_N$) and said control signal ($U_i$) are regular pulse trains, and the duty cycle of said emergency operation signal ($U_N$) is smaller than that of said control signal ($U_i$).

7. An emergency operation device as defined by claim 1, wherein said logic switching means for said control signal ($U_i$) and said emergency operation signal ($U_N$) comprises an OR gate having a common triggering of one input of a first comparator, a further comparator being disposed in series therewith so as to receive said control signal ($U_i$), said further comparator being arranged to supply a positive signal to said first comparator upon the occurrence of said failsafe signal ($U_{FS}$).

8. An emergency operation device as defined by claim 1, further comprising said function generator has a duty cycle adjustable in accordance with said signal inputs corresponding to said operating parameters of the engine.

9. An emergency operation device as defined by claim 8 wherein said function generator is a monostable multivibrator set in synchronism with a reference signal of said system, in particular an ignition signal of a motor vehicle.

10. An emergency operation device as defined by claim 9, wherein the timing duration of said monostable multivibrator is adjustable.

11. An emergency operation device as defined by claim 10, wherein said monostable multivibrator is positively coupled with a comparator, the non-inverting input of which is connected both to ground via a capacitor and to the output of a further comparator, to which both a reference voltage and a reference signal of the system are supplied, and the inverting input of said further comparator connected with a voltage dependent on operating parameters.

12. An emergency operation device as defined by claim 1, wherein said circuit means is triggered via a capacitor by said failsafe output of said microcomputer.

13. An emergency operation device as defined by claim 1, wherein said failsafe output of said microcomputer is switched to a reference potential upon the occurrence of said failsafe signal ($U_{FS}$).

14. An emergency operation device as defined by claim 1, wherein said circuit means includes an RC member connected in series therewith to the control input of a switching transistor, which charges a capacitor in the input of a comparator via a resistor, and said input of said circuit means can be decoupled from said failsafe output of said microcomputer via a diode.

15. An emergency operation device as defined by claim 1, wherein upon the transition from emergency operation (reset) to regular operation, said system at first continues to be operated with said control signal ($U_i$) corresponding to the most recently existing emergency operation signal ($U_N$), until said microcomputer has again ascertained all the register values from the current operating parameters.

16. An emergency operation device as defined by claim 1, wherein said control signal ($U_i$) generated by said microcomputer is monitored for plausibility and in the case of a non-plausible signal said circuit means is activated.

17. An emergency operation device as defined by claim 14, wherein said circuit means, in the event said failsafe output has a persistent short-circuit to a reference potential or ground, functions as a freely oscillating oscillator, having a duty cycle defined by the ratio between unblocking signal duration and the sum of unblocking signal plus blocking signal duration ($t_f/(t_f+t_s)$), said duty cycle being dimensioned such that satisfactory emergency operation is possible.

18. An emergency operation device as defined by claim 1, wherein the output of said circuit means is connected directly with an input of an end stage.

19. An emergency operation device as defined by claim 18, wherein said failsafe signal is supplied directly, as an emergency operation signal, to said end stage.

* * * * *